US008806809B1

(12) United States Patent
Lawrence

(10) Patent No.: US 8,806,809 B1
(45) Date of Patent: Aug. 19, 2014

(54) WINDOW VENT STOP AND METHOD

(71) Applicant: Barry G. Lawrence, Thomasville, NC (US)

(72) Inventor: Barry G. Lawrence, Thomasville, NC (US)

( * ) Notice: Subject to any disclaimer, the term of this patent is extended or adjusted under 35 U.S.C. 154(b) by 0 days.

(21) Appl. No.: 13/803,749

(22) Filed: Mar. 14, 2013

(51) Int. Cl.
*E05C 17/44* (2006.01)
*E05B 65/08* (2006.01)

(52) U.S. Cl.
CPC ..... *E05B 65/0852* (2013.01); *E05D 13/06* (2013.01); *Y10S 292/47* (2013.01)
USPC ..... 49/449; 292/338; 292/DIG. 47

(58) Field of Classification Search
CPC ... E05B 3/02; E05B 65/0852; E05B 65/0835; E05B 63/18; E05C 17/60
USPC ..... 49/176, 183, 186, 449; 292/338, 292/DIG. 20, DIG. 46, DIG. 47
See application file for complete search history.

(56) References Cited

U.S. PATENT DOCUMENTS

| | | | | | |
|---|---|---|---|---|---|
| 804,994 | A * | 11/1905 | Andrwes | 292/219 |
| 976,777 | A * | 11/1910 | Brown | 292/63 |
| 1,485,382 | A * | 3/1924 | Foley | 292/219 |
| 4,923,230 | A * | 5/1990 | Simpson | 292/67 |
| 5,248,174 | A * | 9/1993 | Matz et al. | 292/338 |
| 5,536,052 | A * | 7/1996 | Maier | 292/63 |
| 5,575,116 | A * | 11/1996 | Carlson et al. | 49/449 |
| 6,572,158 | B2 * | 6/2003 | Szapucki et al. | 292/221 |
| 7,431,356 | B2 * | 10/2008 | Liang et al. | 292/219 |
| 7,530,611 | B2 * | 5/2009 | Liang et al. | 292/338 |
| 7,588,271 | B1 | 9/2009 | Lawrence | 292/241 |
| 8,182,001 | B2 | 5/2012 | Tremble et al. | 292/32 |
| 8,235,430 | B2 * | 8/2012 | Liang et al. | 292/338 |
| 2009/0206616 | A1 * | 8/2009 | Liang et al. | 292/338 |
| 2010/0281780 | A1 | 11/2010 | Liang et al. | 49/449 |
| 2011/0113695 | A1 * | 5/2011 | Derham | 49/445 |
| 2012/0167475 | A1 * | 7/2012 | Sopkowiak et al. | 49/449 |

* cited by examiner

*Primary Examiner* — Katherine Mitchell
*Assistant Examiner* — Abe Massad
(74) *Attorney, Agent, or Firm* — Blake P. Hurt

(57) ABSTRACT

A vent stop to be used on windows such as double sash windows allows desired ventilation while preventing the window from fully opening for safety reasons. The vent stop includes a lever having a notch for engaging the housing top lip while the stop is in a closed position and for disengaging the top lip when the lever is to be extended for terminating sash movement. Side apertures on the housing which receive axles on the lever are sized to allow both pivotal and longitudinal movement of the lever. A spring keeper maintains a coil spring in position while the lever moves from a closed to an open posture.

11 Claims, 4 Drawing Sheets

WINDOW VENT STOP AND METHOD

FIELD OF THE INVENTION

The invention herein pertains to vent stops and particularly pertains to vent stops as used to provide a limited sash opening in a double hung window.

DESCRIPTION OF THE PRIOR ART AND OBJECTIVES OF THE INVENTION

Various types of vent stops have been used for many years to allow a double sash window to provide ventilation while restricting the window from fully opening for safety concerns. Such conventional vent stops generally include a housing and a moveable lever contained therein which can be opened or closed, depending on the user's choice.

Previous vent stops have sometimes malfunctioned due to slippage as the lever releases or is urged into the housing. Other prior art vent stops have experienced uneven wear and do not function properly for extended periods of time.

Thus, in view of the problems and disadvantages associated with prior art devices, the present invention was conceived and one of its objectives is to provide a vent stop which is relatively easy and inexpensive to manufacture, assemble and install.

It is another objective of the present invention to provide a vent stop which will be long lasting and provide years of useful service.

It is still another objective of the present invention to provide a vent stop which will engage a window sash at a desired height to provide maximum benefit and ventilation.

It is yet another objective of the present invention to provide a vent stop which has a spring loaded lever which can be easily opened and closed as required.

It is a further objective of the present invention to provide a vent stop housing having opposing side apertures which are larger than the corresponding axles to provide both rotational and longitudinal movement of the lever.

It is still a further objective of the present invention to provide a lever for a vent stop which includes a lever tab to allow the lever to be easily opened or extended.

It is yet a further objective of the present invention to provide a vent lever that can be installed as conventional by relatively inexperienced personnel.

Various other objectives and advantages of the present invention will become apparent to those skilled in the art as a more detailed description is set forth below.

SUMMARY OF THE INVENTION

The aforesaid and other objectives are realized by providing a vent stop and method of use for dependable, safe ventilation for a home owner or others employing double hung windows. One or more vent stops can be easily installed in a conventional window stile and provide concern-free service for many years. The vent stop includes a pivotable lever having a terminal notch to engage the top lip of the housing while closed and an opposingly positioned tab for release of the lever. The lever is spring loaded and contains a coil spring which urges it to an outward or open position as needed when the tab is pressed. The tab on the lever is manually depressed causing rotation of the lever, disengagement of the notch from the lip through longitudinal movement that allows the lever to clear the housing for extension purposes. Elongated, arcuate apertures on each side of the housing provide guidance for axially aligned lever lugs for smooth even movement as the lever opens or extends.

In the method of use, a side of the housing is removed for assembly purposes. The removable housing side includes a pair of fingers which engage sockets in the housing for quick and rapid assembly. Before the side is reattached to the housing a spring is placed in a channel in the lever and the lever is inserted in the housing with one end of the spring positioned in a spring keeper integrally formed in the housing. The side is then installed to maintain the spring and lever in position. The assembled vent stop can then be positioned in a precut opening in a typical double hung window stile. Catches on the ends of the vent stop maintain it in place in the stile. In use, the lever tab is depressed causing the lever to rotate and move longitudinally, disengaging from the housing top lip. As it disengages the spring forces the lever to extend from the housing as it rotates or pivots. This extended lever then provides a stop for the sash as it can only be partially opened. The sash opening supplies limited ventilation for the building occupants while preventing unauthorized entry due to its small size.

The window sash can be fully opened by urging the lever into a closed position within the housing. When closed the lever notch again engages the housing top lip as the lever rotates and longitudinally moves into its closed position.

DETAILED DESCRIPTION OF THE PREFERRED EMBODIMENT AND OPERATION OF THE INVENTION

Figure 1:
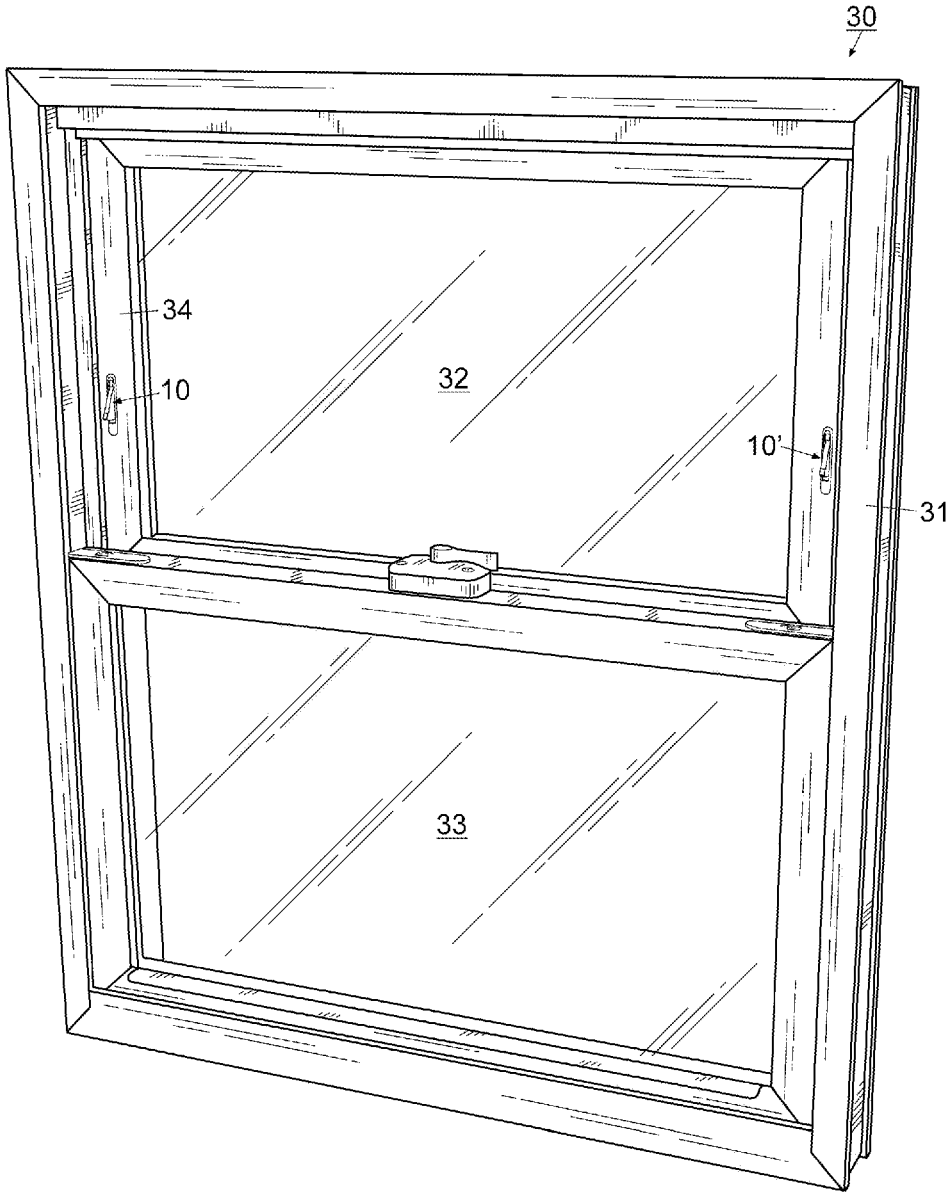
FIG. 1 shows a perspective view of a double hung window with a pair of vent stops installed in the frame.
Figure 4:
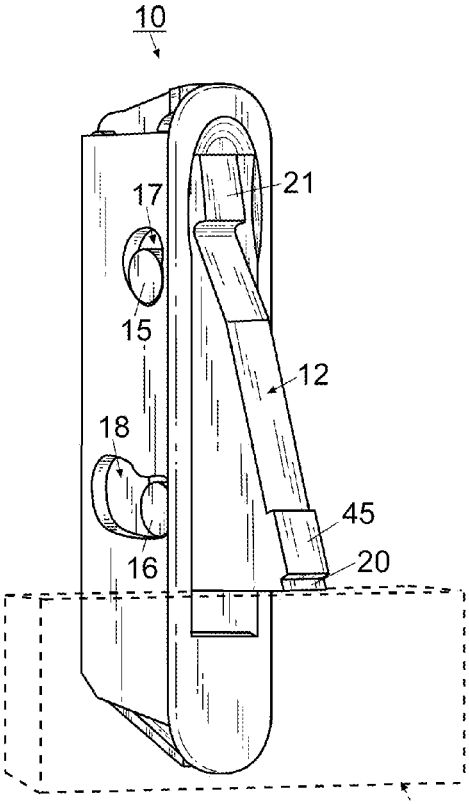
FIG. 4 demonstrates the vent stop in an open posture engaging a window sash which is shown in dashed lines.
Figure 3:
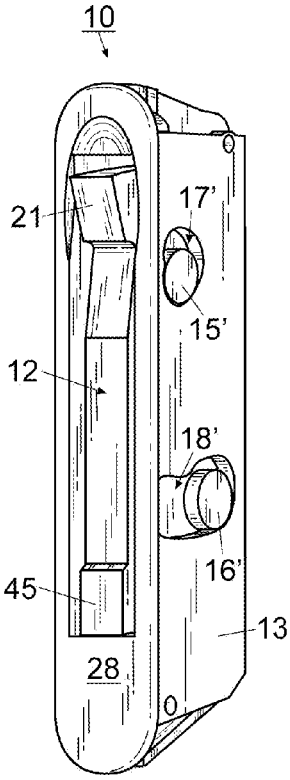
FIG. 3 depicts a perspective view of the vent stop in a closed posture.

For a better understanding of the invention, turning now to the drawings, a conventional double hung window 30 is shown in FIG. 1 having frame 31 containing upper sash 32 and lower sash 33. Mounted on the inside of frame 31 on stile 34 is preferred vent stop 10 in an open position with opposing vent stop 10' in the opposite stile. As understood, when vent stop 10 is closed as shown in FIG. 3 sash 33 can be opened fully for maximum ventilation. When vent stop 10 is opened as shown in FIG. 4, lever 12 contained within vent stop housing 13 pivots outwardly to limit the amount of ventilation as it prevents further movement of sash 33 when raised as schematically seen in FIG. 4.

Figure 2:
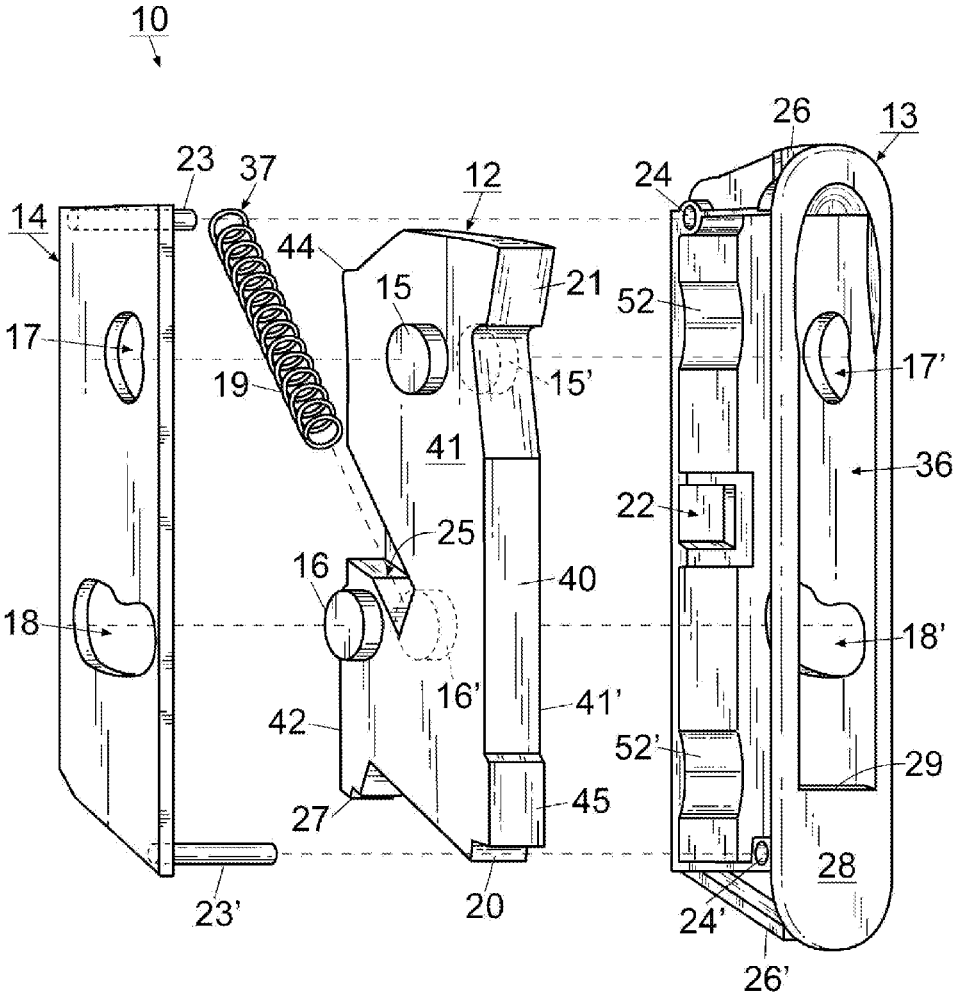
FIG. 2 illustrates an exploded perspective view of a vent stop.

The preferred form of vent stop 10 is seen in exploded fashion in FIG. 2 having removable housing side 14, housing 13 and lever 12. Removable housing side 14 includes diagonally opposing fingers 23, 23' on the inside thereof for engagement respectively with diagonally opposing sockets 24, 24' of housing 13. Vent stop 10 is preferably formed from a polymeric material although metals, composites or the like may be used. Removable side 14 further includes side aperture 17 and elongated aperture 18. Housing 13 includes side aperture 17' and elongated aperture 18' which are axially aligned with respectively side aperture 17 and elongated aperture 18 of removable side 14 when vent stop 10 is assembled. Elongated apertures 18, 18' are somewhat arcuate in shape having a larger or more bulbous end towards the bottom of housing 13 and allow for both rotational and limited longitudinal movement of respectively lugs 16, 16'. Housing 13 further includes a pair of protuberances 52, 52' (FIG. 6) formed on the bottom thereof with U-shaped spring keeper 22 (FIG. 5) positioned therebetween and opposing cavity 36 (FIG. 2) formed in top 28 with surrounding top lip 29. Housing catches 26, 26' are formed in opposing relation on the outside of housing 13 for positioning and maintaining vent stop 10 within a window stile such as stile 34.

Lever 12 is somewhat rectangular in shape and includes top 40, sides 41, 41' and bottom 42. Tab 21 is formed on one end of top 40 with mound 45 and notch 20 formed on the opposite end while nub 44 is formed in bottom 42 below tab 21 and opposing shoulder 27 is formed below notch 20 proximate bottom 42. Lever 12 is formed having opposing axially aligned axles 15, 15' and opposing axially aligned lugs 16, 16' for positioning within respectively side apertures 17, 17' and elongated apertures 18, 18' of housing 13. Lever 12 further includes spring groove 25 formed through bottom 42 in side 41 for receiving spring 19 therein.

Figure 5:
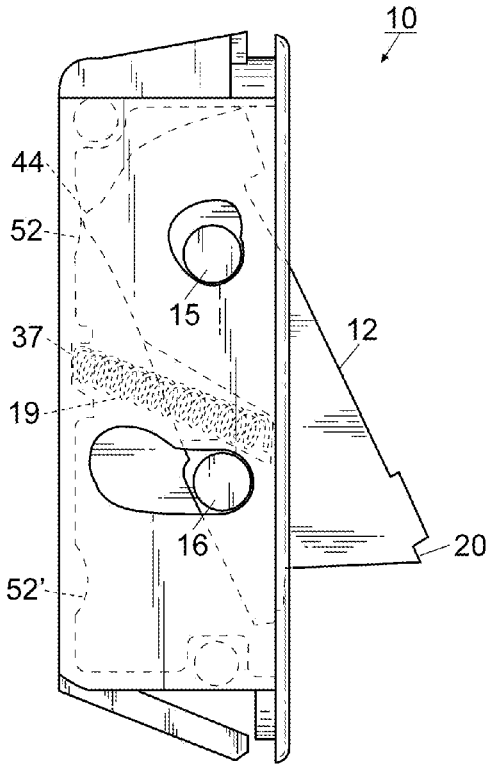
FIG. 5 shows a side elevational view of the vent stop with the lever shown in a dashed line open posture.
Figure 6:
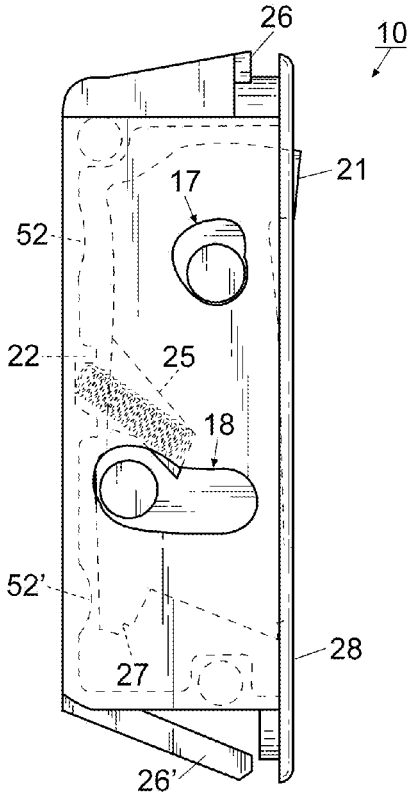
FIG. 6 depicts a side elevational view of the vent stop with the lever shown in a dashed line closed posture.

When lever 12 is closed (manually urged into housing 13) as seen in FIGS. 3 and 6, terminal notch 20 engages top lip 29 on housing top 28 as bottom 42 hovers above keeper 22 and protuberances 52, 52' as spring 19 maintains lever 12 elevated therefrom. When opened lever 12 rotates about side axles 15, 15' as shown in FIG. 2 which are in axial alignment on respectively, sides 41, 41' of lever 12. Side apertures 17, 17' shown in FIG. 2 are oversized and somewhat bulbous in shape to allow for both rotational and longitudinal movement when opening and closing lever 12 (axles 15, 15'). This longitudinal movement allows notch 20 of lever 12 which is loaded by spring 19 to engage top lip 29 seen in FIG. 2 and to easily disengage from top lip 29 when tab 21 on lever 12 is manually depressed. Spring 19 is maintained within groove 25 of lever 12 at one end and is contained by keeper 22 of housing 13 at the other end. U-shaped keeper 22 comprises a pair of opposing ridges formed along the bottom of housing 13 as seen in FIG. 5 and contains free end 37 (FIG. 2) of spring 19.

During assembly of vent stop 10, lever 12 is inserted into housing 13 with housing side 14 removed. During insertion, axle 15' is placed into side aperture 17' and lug 16' is placed into elongated aperture 18' as shown in FIG. 2. Next, spring 19 is positioned in groove 25 with free end 37 placed in keeper 22. Next, fingers 23, 23' of side 14 are positioned in respectively housing sockets 24, 24' and side 14 is then pressed into engagement with housing 13. When so assembled, notch 20 engages top lip 29. Next, to release lever 12, tab 21 is depressed which causes lever 12 to pivot and slide rearwardly away from lip 29 whereby notch 20 is disengaged from top lip 29. Spring 19 then urges lever 12 outwardly to open as shown in FIGS. 4 and 5. Lever shoulder 27 then strikes top lip 29 from beneath and the movement of axles 15, 15' and lugs 16, 16' stops within respectively side apertures 17, 17' and elongated apertures 18, 18' and nub 44 rests against protuberance 52. Such "angling" assists in "wedging" lever 12 into an open posture within housing 13 for added security and operation of vent stop 10 to prevent further opening of a window sash, such as sash 33. Later, during closure of vent stop 10, mound 45 of lever 12 is depressed to disengage shoulder 27 from top lip 29 and axles 15, 15' and lugs 16, 16' move along respectively side apertures 17, 17' and elongated apertures 18, 18' as lever 12 moves downwardly (pivotally) and slightly rearwardly (longitudinally) until notch 20 again engages top lip 29. Spring 19 is again compressed within lever 12 and maintains pressure of notch 20 against top lip 29 of housing 13 to maintain vent stop 10 closed.

The method of use includes the assembly of vent stop 10 as previously described herein and its use in a double hung window or otherwise to provide adequate and secure ventilation to a building or other structure. Assembled vent stop 10 can be positioned in a precut opening (not shown) in a typical double hung window stile such as stile 34 of window 30 shown in FIG. 1. Catches 26, 26 (FIG. 6) on the ends of vent stop 10 provide for a snap-fit and maintain vent stop 10 in place. In use, tab 21 is depressed causing lever 12 to rotate and move longitudinally, disengaging notch 20 from housing top lip 29. Simultaneously during such movement, axles 15, 15' are rotated moving slightly rearwardly then upwardly at an angle within respectively bulbous side apertures 17, 17'. Lugs 16, 16' are likewise simultaneously moving slightly rearwardly then upwardly within respectively elongated apertures 18, 18'. Side apertures 17, 17' and elongated apertures 18, 18' are large enough to allow for slight longitudinal movement of lever as notch 20 must be moved rearwardly from top lip 29 for disengagement therefrom. As notch 20 disengages compressed resilient member 19 comprising a coil spring decompresses, forcing lever 12 to extend outwardly (FIG. 5) from housing 13 through cavity 36 as lever 12 rotates or pivots whereby shoulder 27 engages top lip 29 and nub 44 engages protuberance 52 to assist in stopping further movement and protrusion of lever 12. Extended lever 12 then provides a stop for partially opened sash 33 shown (in dashed line fashion) in FIG. 4. The sash opening (not shown) supplies limited ventilation for the building occupants.

Window sash 33 can be fully opened by urging lever 12 into a closed position within housing 13 as seen in FIGS. 3 and 6. When closing, mound 45 above notch 20 is pushed downwardly to compress spring 19 and disengage shoulder 27 from top lip 29 whereby nub 44 slides from protuberance 52. Simultaneously, axles 15, 15' and lugs 16, 16' move within respectively side apertures 17, 17' and elongated apertures 18, 18' to return lever 12 to a fully closed position within housing 13. Notch 20 of lever 12 again engages top lip 29 and maintains vent stop 10 in a closed posture.

The illustrations and examples provided herein are for explanatory purposes and are not intended to limit the scope of the appended claims.

I claim:

1. A vent stop comprising: a housing, said housing defining a cavity and a side aperture, a lip, said lip surrounding said cavity, a lever, a side axle, said side axle attached to said lever, said side axle contained within said side aperture, a tab, said tab mounted on said lever, said tab extending from said housing when said lever is in a closed position, said lever pivotally mounted within said cavity for outward extension from said cavity, said lever defining a lip engaging notch and a groove, a resilient member, said resilient member contained within said groove, whereby said lever can be urged into said housing to compress said resilient member and said lip engaging notch engaged with said lip to secure said lever therein, whereby depressing said tab displaces said side axle within said side aperture such that said side aperture frictionally guides said side axle both pivotally and longitudinally, resulting in disengagement of said lip engaging notch from said lip; wherein said housing defines an elongated aperture, a lug, said lug attached to said lever, said lug pivotally and longitudinally displaceable within said elongated aperture for guiding said lever during pivoting when said tab is depressed.

2. The vent stop of claim 1 wherein said housing defines a pair of opposing side apertures, a pair of side axles, each of said pair of side axles aligned on opposite sides of said lever, each of said pair of side axles positioned in different ones of said pair of side apertures which frictionally displace both said side axles pivotally and longitudinally within each of said side apertures when said tab is depressed.

3. The vent stop of claim 1 wherein said housing defines a pair of opposing elongated apertures, a pair of lugs, each of said pair of lugs attached to different sides of said lever and positioned in different ones of said pair of elongated apertures, said lugs pivotally and longitudinally displaceable within said elongated apertures.

4. The vent stop of claim 1 further comprising a top, said top affixed over said cavity, said top defining an opening, said lip attached to said top.

5. The vent stop of claim 1 wherein said resilient member comprises a spring.

6. The vent stop of claim 1 further comprising a flexible catch, said catch attached to said housing for engaging a window frame.

7. The vent stop of claim 4 wherein said housing is formed from a polymeric material.

8. A vent stop comprising: a housing, said housing defining a cavity, a lever, said lever pivotally mounted within said housing, said lever defining a notch and a tab, said notch in opposing relation to said tab, a pair of side axles, each of said pair of side axles axially aligned on different sides of said lever, said housing defining a pair of apertures, said side axles contained within different ones of said pair of apertures, and said tab extending from said housing when said lever is in a closed position, whereby depressing said tab displaces said side axles within said side apertures such that said side apertures frictionally guide said side axles both pivotally and longitudinally resulting in disengagement of said notch from a lip defined by said housing, wherein said housing defines an elongated aperture, a lug, said lug attached to said lever, said lug pivotally and longitudinally displaceable within said elongated aperture for guiding said lever during pivoting when said tab is depressed.

9. The vent stop of claim 8 further comprising a resilient member, said lever defining a groove, said resilient member positioned in said groove.

10. The vent stop of claim 8 further comprising a second lug, said second lug attached to said lever.

11. The vent stop of claim 8 further comprising a protuberance, wherein said lever further defines a nub, said protuberance positioned on said housing, said nub engaging said protuberance when said level is in an open position.

* * * * *